US008297272B2

(12) United States Patent
Williams et al.

(10) Patent No.: US 8,297,272 B2
(45) Date of Patent: Oct. 30, 2012

(54) STOVE POT RETAINER

(75) Inventors: Phillip Williams, Clinton, CT (US); Michael Reischmann, Eustis, FL (US)

(73) Assignee: Kenyon International, Inc., Clinton, CT (US)

( * ) Notice: Subject to any disclaimer, the term of this patent is extended or adjusted under 35 U.S.C. 154(b) by 346 days.

(21) Appl. No.: 12/567,230

(22) Filed: Sep. 25, 2009

(65) Prior Publication Data

US 2010/0078006 A1 Apr. 1, 2010

Related U.S. Application Data

(60) Provisional application No. 61/100,536, filed on Sep. 26, 2008.

(51) Int. Cl.
*F24C 3/12* (2006.01)

(52) U.S. Cl. ..... 126/42; 126/24; 126/50

(58) Field of Classification Search ..... 126/24, 126/42, 30, 40, 50; 114/188; 248/500, 505, 248/507
See application file for complete search history.

(56) References Cited

U.S. PATENT DOCUMENTS 2,379,206 A 6/1945 Westlake
2,565,694 A * 8/1951 Little ..... 126/24
5,575,445 A 11/1996 Kozdas

* cited by examiner

*Primary Examiner* — Alfred Basichas
(74) *Attorney, Agent, or Firm* — St. Onge Steward Johnston & Reens LLC

(57) ABSTRACT

A device and system for increasing the safety of portable stoves or stoves used in unstable conditions. The device includes at least one support member and at least one retaining member slidably disposed on the support member. The retaining member has an anchoring mechanism movably disposed on it that is used to lock it into place with respect to the support member. The retaining member contacts the sides of a pot or other cooking vessel when in an active position and may be moved into a stowed position.

17 Claims, 5 Drawing Sheets

STOVE POT RETAINER

CROSS-REFERENCE TO RELATED APPLICATIONS

This patent application claims the benefit, under 35 U.S.C. §119(e), of U.S. Provisional Patent Application Ser. No. 61/100,536, filed on Sep. 26, 2008, which is hereby incorporated by reference herein.

FIELD OF THE INVENTION

The subject invention relates to a device for reducing or preventing unwanted movement of a pot or other cooking vessel on a stove. In particular, the present invention relates to a cooking vessel retaining device for use on stoves that are portable or built in to a vehicle.

BACKGROUND OF THE INVENTION

Portable cooking appliances, such as stoves, are used all over the world in many environments. For example, people who enjoy camping, boating, sailing, or traveling by RV desire a small, portable stove for preparing meals while in transit or in a location that is remote from any working kitchen. Portable stoves take the form of electric, induction, gas-burning, etc. depending on, for example, whether the stove is mounted in a vehicle such as an RV or boat.

When meals are being prepared in a moving vehicle, such as a boat or RV, there is a significant danger that a cooking vessel being used on the stove may slide off of the stove and create a spill or other dangerous condition. (In the present application, a "cooking vessel" means any pot, pan, or other device used to hold or contain food to be heated or cooked). Such a dangerous condition may also occur if the stove is used on an uneven or excessively soft surface, such as one that may be encountered while camping. For this reason, portable stoves are often equipped with a device or system intended to prevent or reduce unwanted movement of the cooking vessels. Many such devices are known in the prior art, but these devices are excessively complicated to manufacture, assemble, and use.

For example, U.S. Pat. No. 2,379,206 to Westlake discloses a means for holding cooking vessels on galley stoves that includes arms mounted on bars that are mounted on a rail. The arms are intended to partially wrap around a cooking vessel, and are designed with varying shapes and lengths. The position of the arms is set by means of wing nuts. The complexity and difficulty of use of the Westlake system is apparent, however, from FIG. 1. Not only must a user of the system adjust the position of the arms relative to one another, but the user must adjust the position of the bar relative to the rail and cooking vessels both in latitude and longitude with respect to the stove.

U.S. Pat. No. 5,575,445 to Kozdas discloses a system for use with a conventional stove in which a clamping device for grasping the handle of a cooking vessel is provided. The system utilizes claws mounted on a collar that is in turn slidably mounted on a vertical support member. The claws are curved and spring biased for clamping onto the handle of a cooking vessel. The mounting collar may be locked into position on the support member by a pressure fit system, a cam system, or a screw-type system. The support member is attached to a rail mounted along the side of the stove. Again, however, the system is complicated and relatively difficult to use. In order to secure a single cooking vessel, the position of the support member on the rail must be adjusted, the position of the mounting collar on the support member must be adjusted, and the positions of the claws must be adjusted.

Clearly, the devices known from the prior art for reducing the amount of unwanted movement of cooking vessels on a portable stove are excessively complicated and difficult to use. This excessive complication and difficulty of use serves to discourage use of the devices, even on stoves that are equipped with them, thereby perpetuating the unsafe condition the devices were intended to alleviate.

Thus, what is needed is a simple but effective device for reducing the amount of unwanted movement of a cooking vessel on a stove. The device should be simple to manufacture, simple to install, and simple to use. The device should be inexpensive, but should not detract significantly from the aesthetic value of the stove with which it is associated.

SUMMARY OF THE INVENTION

Accordingly, it is an object of the present invention to provide a device for increasing the safety of stoves used on moving vehicles or in other unstable conditions.

It is yet a further object of the present invention to provide a cooking vessel retaining device that is simple to manufacture, install, and use.

It is still another object of the present invention to provide a cooking vessel retaining device that does not detract from the aesthetic value of the stove with which it is associated.

These and other objects are achieved by a first embodiment of the invention, by provision of a device for securing at least one cooking vessel placed in at least one cooking zone of a stove, where the device comprises: at least one support member proximate to the at least one cooking zone; at least one retaining member for contacting the at least one cooking vessel when the at least one retaining member is in an active position. The at least one retaining member is slidably supported by the at least one support member. At least one anchoring mechanism is movably disposed on the at least one retaining member, the at least one anchoring mechanism being movable between a locked position in which it inhibits movement of the at least one retaining member relative to the at least one support member and an unlocked position in which the at least one retaining member is permitted to slide relative to the at least one support member.

In some embodiments, the at least one support member includes at least one stow port is adapted to support the at least one retaining member in a stowed position. In some embodiments, the at least one retaining member comprises a first retaining member and a second retaining member each slidably supported by the at least one support member. The at least one anchoring mechanism comprises a first anchoring mechanism and a second anchoring mechanism, the first anchoring mechanism being movably disposed on the first retaining member and the second anchoring mechanism being movably disposed on the second retaining member.

In some embodiments, the at least one support member comprises a first support member and a second support member and the first retaining member is slidably supported by the first support member and the second retaining member is slidably supported by the second support member.

In some embodiments, the at least one support member is proximate to a first cooking zone and a second cooking zone. The at least one retaining member comprises a first retaining member and a second retaining member for contacting a cooking vessel placed in the first cooking zone and a third retaining member and a fourth retaining member for contacting a cooking vessel placed in the second cooking zone, each retaining member being slidably supported by the at least one support member. The at least one anchoring mechanism comprises a first anchoring mechanism movably disposed on the first retaining member, a second anchoring mechanism movably disposed on the second retaining member, a third anchoring mechanism movably disposed on the third retaining member, and a fourth anchoring mechanism movably disposed on the fourth retaining member.

According to a second embodiment of the present invention, a device for securing at least one cooking vessel placed in at least one cooking zone of a stove is provided, the device comprising: at least one support member located proximate to the at least one cooking zone of a stove, the at least one support member having a channel formed along its length; at least one retaining member having a protrusion on an end thereof and an elongated portion for contacting the at least one cooking vessel when the retaining member is in an active position, the protrusion being slidably disposed in the channel; and at least one anchoring mechanism movably disposed on the at least one retaining member, the at least one anchoring mechanism being movable between a locked position in which it bears against the at least one support member for anchoring the retaining member in place and an unlocked position in which the retaining member is permitted to slide relative to the at least one support member.

In some embodiments, the at least one support member has at least one notch formed adjacent to the channel, the notch being sized to accommodate the elongated portion of the retaining member when the retaining member is placed in a stowed position. In some embodiments, the at least one notch is formed on a portion of the at least one support member such that the angle formed by the elongated portion when it is in the active position and the elongated portion when it is in the stowed position is about 90°.

In some embodiments, the at least one support member is secured to a lid, and the lid is attached to a stove housing by a hinge. In some embodiments, a portion of the hinge is integral with the at least one support member. In some embodiments, the at least one support member is adapted to engage a stove cut-off switch mounted on the stove housing.

In some embodiments, the at least one retaining member comprises two retaining members, and the elongated portion of each retaining member is curved for fitting around a cooking vessel. In some embodiments, the elongated portion of the at least one retaining member includes an area having threads and wherein the at least one anchoring member is a sleeve disposed coaxially on the elongated portion that has threads that correspond to those on the elongated portion.

According to a third embodiment of the present invention, a stove is provided, which comprises: a housing; at least one heating element disposed in the housing and forming at least one cooking zone for heating a cooking vessel; a lid, attached to the housing by a hinge; at least one support member proximate to the cooking zone; the at least one support member having a channel formed along its length; a first retaining member having a first protrusion on an end thereof and a first elongated portion for contacting a cooking vessel when the first retaining member is in an active position, the first protrusion being slidably disposed in the channel; a second retaining member having a second protrusion on an end thereof and a second elongated portion for contacting a cooking vessel when the second retaining member is in an active position, the second protrusion being slidably disposed in the channel; a first anchoring mechanism movably disposed on the first retaining member, the first anchoring mechanism being movable between a locked position in which it bears against the at least one support member for anchoring the first retaining member in place and an unlocked position in which the first retaining member is permitted to slide relative to the at least one support member; and a second anchoring mechanism movably disposed on the second retaining member, the second anchoring mechanism being movable between a locked position in which it bears against the at least one support member for anchoring the second retaining member in place and an unlocked position in which the second retaining member is permitted to slide relative to the at least one support member.

In some embodiments, the at least one support member is attached to the lid and a portion of the hinge is integral with the at least one support member. In some embodiments, the at least one support member further comprises: a first notch formed adjacent to the channel, the first notch being sized to accommodate the first elongated portion when the first retaining member is in a stowed position; and a second notch formed adjacent to the channel, the second notch being sized to accommodate the second elongated portion when the second retaining member is in a stowed position.

In some embodiments, the channel is accessible via an opening made on a front surface of the at least one support member and the first and second notches are formed in a top surface of the at least one support member that is adjacent to the front surface such that the angle formed by the first and second elongated portions when they are in the active position and the first and second elongated portions when they are in the stowed positions is about 90°.

In some embodiments, the stove further comprises a stove cut-off switch mounted on the housing in a position that activation of the stove cut-off switch by the lid when the lid is placed in a closed position.

The invention and its particular features and advantages will become more apparent from the following detailed description considered with reference to the accompanying drawings.

DETAILED DESCRIPTION OF THE INVENTION

Figure 1:
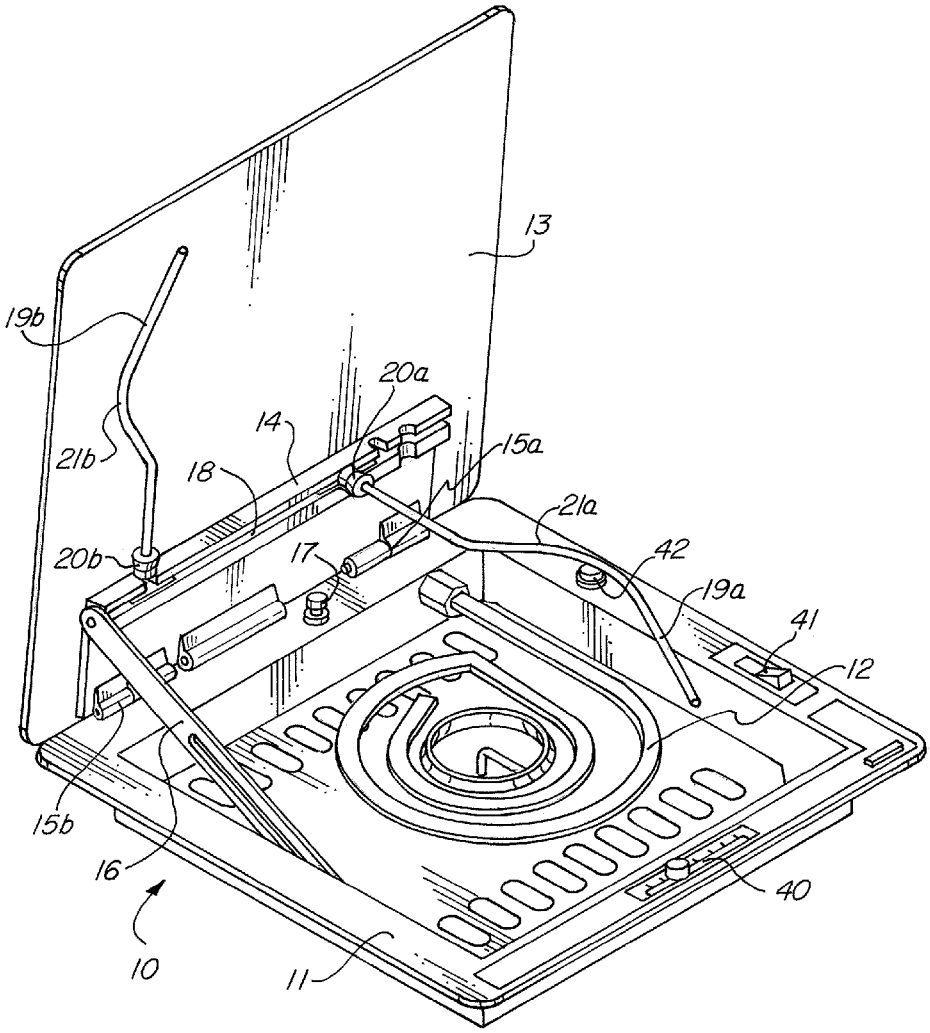
FIG. 1 is an isometric view of a stove that includes a pot retaining device according to the present invention.

FIG. 1 shows a stove 10. The stove 10 is adapted for mounting in a mobile home, RV, or boat that is suitably outfitted. The stove housing 11 is shaped to fit in a cut-out portion of a counter or tabletop (not shown) as is well known in the art. In the embodiment shown, the housing 11 is square, but in other embodiments, the housing takes a variety of shapes, including: rectangular, circular, ovoid, and the like. In the embodiment shown, the housing 11 is constructed out of stainless steel, but other materials suitable for housing a stove are used in other embodiments.

The stove 10 includes an electric heating element 12 for creating a cooking zone into which a cooking vessel can be placed to be heated. Of course, the present invention is advantageously applied to any type of stove, including induction, gas-burning, wood-burning, alcohol-burning, combination electric and alcohol-burning, and the like. In some embodiments, a substantially flat stovetop surface is provided above the heating element, such as when an induction or electric heating element is used.

The stove 10 includes a lid 13 for covering the heating element and stove 10 when the stove is not in use. The lid 13, in the embodiment shown in FIG. 1, is substantially planar and shaped to correspond to the shape of the housing 11. In some embodiments, the lid may have a convex shape for increased aesthetic appeal. In the embodiment shown, the lid 13 interacts with a safety switch 17, which is activated when the lid 13 is closed. When the safety switch 17 is activated, the heating element is immediately switched off, and cannot be turned on until the switch 17 is de-activated (i.e., until the lid 13 is opened). This safety feature is particularly important when the stove is used in a confined space such as the cabin of a boat or a confined space.

In the embodiment shown in FIG. 1, the lid 13 is mounted on a support member 14 (described in detail below). The support member 14 shown in FIG. 1 is mounted to the housing 11 by hinges 15*a* and 15*b*. The hinges 15*a* and 15*b* are made up of portions 24*a* and 24*b* that are integral parts of the support member 14. The lid 13 is also connected to the housing 11 by the stay arm 16. The stay arm 16 can hold the lid in a locked open position to prevent the lid 13 from accidentally closing.

Also mounted on the housing 11 are controls 40, 41 for operating the heating element 12, and an operation light 42. These features are also covered and protected by the lid 13 when it is in the closed position.

The support member 14, which is in the form of a rail, has a channel 18 running along its length. In other embodiments, the support member 14 is in the form of a ledge and can take a variety of different configurations. In the embodiment shown in FIG. 1, two retaining members 19*a* and 19*b* are disposed in the channel 18. Each retaining member has an anchoring mechanism 20*a* and 20*b* bearing against the support member 14. The retaining members 19*a* and 19*b* each have an elongated portion 21*a*/21*b* for contacting a cooking vessel (not shown in FIG. 1) that is placed in the cooking zone created by the heating element 12. The retaining members 19*a* and 19*b*, in conjunction with the support member 14, serve to reduce or even prevent unwanted movement of cooking vessels being used on the stove 10.

In the embodiment shown in FIG. 1, the retaining members are in the form of cylindrical rods having curved sections. This curved section is obviously intended to provide improved contact with the sides of a cooking vessel. Of course, many different shapes and sizes of retaining members are used in various embodiments of the present invention. For example, retaining members having rectangular cross section or a cross section that changes shape along the length of the elongated portion are also advantageous.

In some embodiments, only a single retaining member 19 is used. In such embodiments, a stationary rod or ledge along one side of the stove 10 serves to bear against one side of the cooking vessel while a single retaining member 19 may be slid into place against the other side of the cooking vessel.

In FIG. 1, the retaining member 19*b* is in the up or "stowed" position, in which it is not able to interact with a cooking vessel. When in the stowed position, the retaining members are up and out of the way such that the lid 13 can be closed. Retaining member 19*a* is in the down or "active" position in FIG. 1, in which position retaining member 19*a* may be used to interact with and secure a cooking vessel.

The support member 14 shown in FIG. 1 and the lid 13 are clamped together in a manner described further below. In this advantageous embodiment, the support member 14 secures the lid and also forms part of the hinges 15*a* and 15*b*, making these parts of the stove simple and inexpensive to manufacture and assemble. The support member and lid are mounted to the housing 11 by other means in other embodiments. In some instances, for example, the support member 14 is not directly connected to the lid 13, but is simply mounted along the edge of the housing 11.

Figure 2:
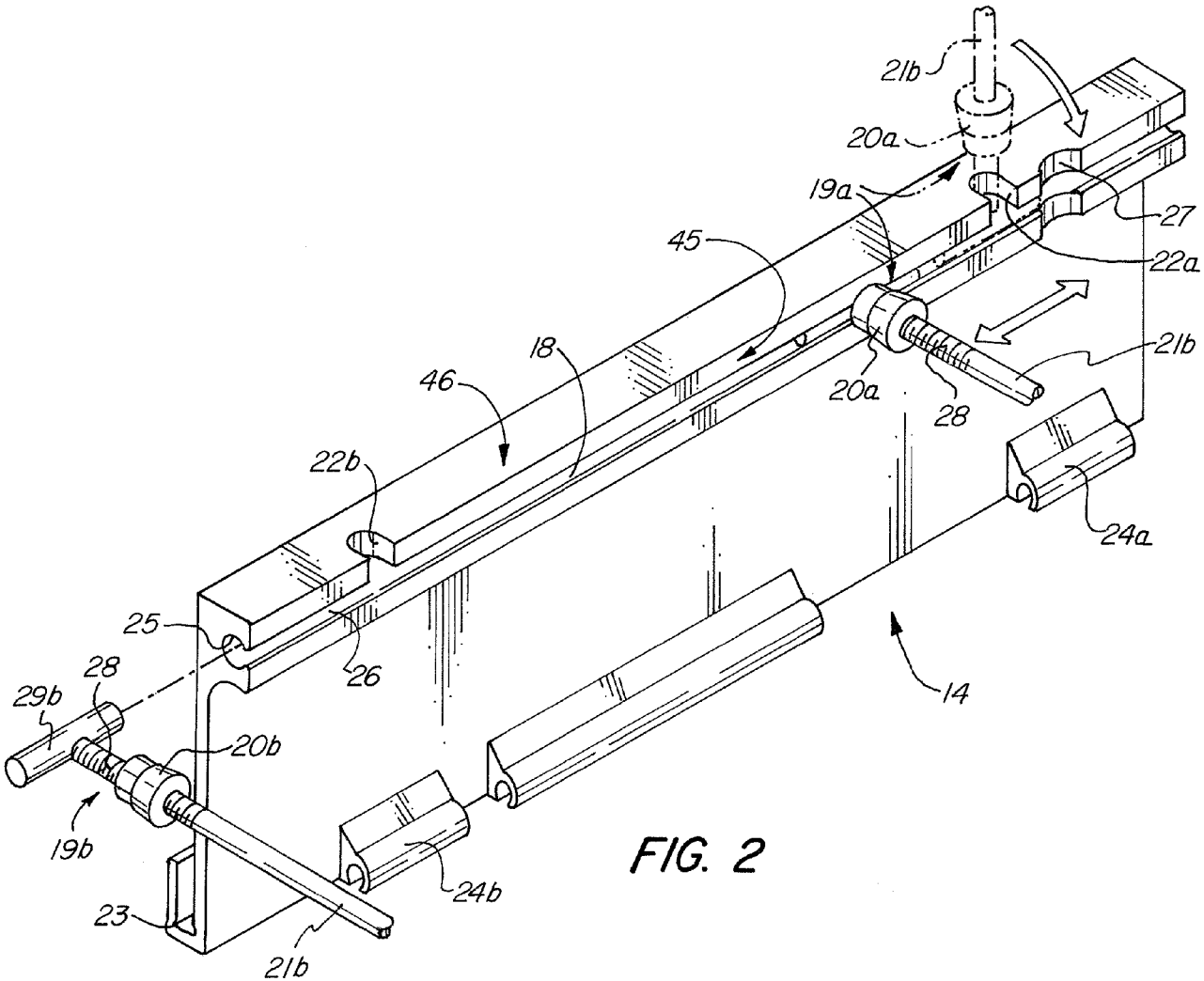
FIG. 2 is an isometric view of the support member used in the stove and pot retaining device shown in FIG. 1.
Figure 3:
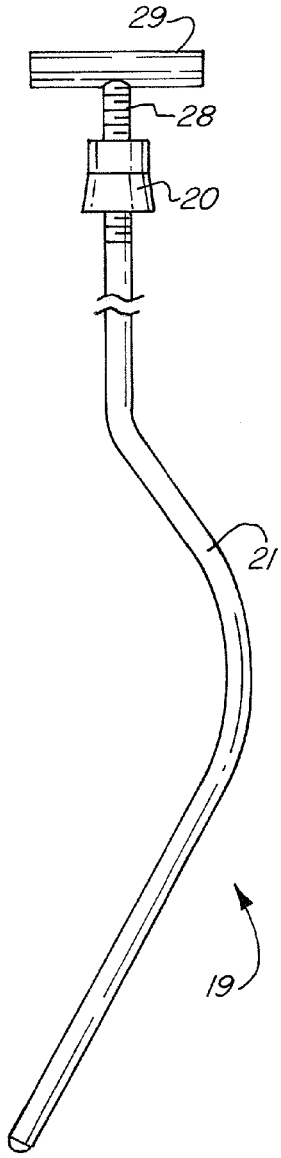
FIG. 3 is a retaining member used in the stove and pot retaining device shown in FIG. 1.

The support member 14 is shown in detail in FIG. 2, and the retaining member 19 is shown in detail in FIG. 3. FIG. 2 also shows in detail the interaction between the support member 14, the protrusion 29 of the retaining member 19, and the anchoring mechanism 20. The support member 14, in the embodiment shown, has a clamp portion 23 for holding the lid 13. Hinge portions 24*a* and 24*b* form part of the hinges 15*a* and 15*b* by which the support member 14 (and lid 13) is mounted to the housing 11. The channel 18 is shown, having a circular cross section (portion 25), and opening on and being accessible through a front surface 45 of the support member. The circular portion 25 of the channel 18 is wider at its widest point than the opening 26 on the front surface. This allows the protrusions 29 of the retaining members 19 to be slidably disposed in the channel 18, such that the elongated portions 21 extend out of the opening 26.

FIG. 2 shows the protrusion 29*b* of retaining member 19*b* in position to be slid into the channel 18. The protrusion 29*b* is in the form of a short cylindrical metal rod having its longitudinal axis oriented perpendicular to the primary longitudinal axis of the elongated portion. Retaining member 19*a* is shown in the "active" position and in the "stowed" position in phantom. In the active position, the anchoring mechanism 20*a* of the retaining member 19*a* is tightened against the support member 14. As also shown in FIG. 3, the anchoring mechanisms 20 of this embodiment are threaded sleeves, or nuts, that engage threads 28 formed on the elongated portion of the retaining members.

The support member 14 shown in FIG. 2 has two "stow ports"—notches 22*a* and 22*b*—to allow two retaining members 19 to be put into a stowed or up position. In the embodiments shown in the figures, the stow ports are notches. However, other features perform the function of the stow ports in other embodiments, for example, ledges, rims, clamps, etc. The phantom drawing of retaining member 19*a* shows the stowed position, but without the anchoring mechanism 20*a* tightened into the locked position to lock the retaining member in the stowed position. The notches 22*a* and 22*b* are formed in the top surface 46 of the support member, which is adjacent to the front surface of the support member, where the opening 26 of the channel resides. The notches 22 permit the retaining members to be placed in the stowed position, which allows the retaining members to be at approximately 90° from their position when they are in the active position. Other angles are used in other embodiments, and depend on the angles of the lid in its upright position relative to the support member and relative to the stove's cooking surfaces. The angle of the retaining members to the horizontal surfaces of the stove is dependent on the design of the support member and the stay arm 16.

The details of the anchoring mechanisms 20 are shown in FIG. 3 and their relationship to the support member 14 is shown in FIG. 2. The anchoring mechanisms 20 are in the form of threaded sleeves, which engage threads 28 on the elongated portions 21. When it is desired to use the retaining members 19 to contact a cooking vessel, they are first put into the active position, like retaining member 19*a* in FIG. 2. They are then slid along the channel 18 of the support member 14 into their desired position. Then, the anchoring mechanisms 20 are tightened on the threads 28 until the anchoring mechanism bears against the front surface 45 of the support member 14. In this way, the protrusion 29 and the anchoring mechanism 20 act as a clamp on the support member 14—preventing or substantially inhibiting the retaining members 19 from sliding.

When it is desired to move the retaining members into the stowed position, to allow for closing of the lid 13, for example, first the anchoring mechanisms 20 are loosened on the front surface of the support. Then, the retaining members are slid to a position directly beneath the notches 22. Next, the retaining members are lifted and rotated upwards so that the elongated portions of the retaining members enter the notches. This position is shown in phantom in FIG. 2. Finally, to lock the retaining members in the stowed position, the anchoring mechanisms 20 are rotated on the threads 28 until the anchoring mechanisms bear against the top surface 46 of the support member. Again, this enables the protrusion 29 and the anchoring mechanism 20 to clamp against the support member 14, but this time on the top surface 46.

The support member 14 shown in FIG. 2 also has a cut-out 27, for accommodating a part of the stove (in this embodiment, the heating element) when the lid 13 is closed.

Figure 2A:
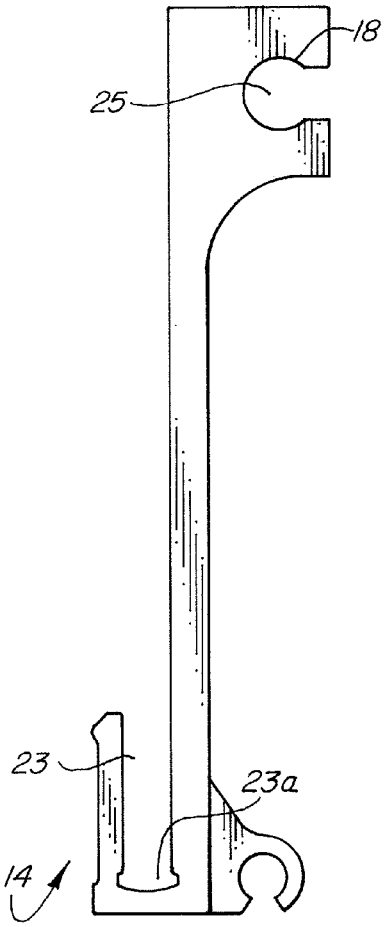
FIG. 2*a* is an end view of the support member shown in FIG. 2.

FIG. 2*a* shows an end view of the support member 14. The clamp portion 23 is used to hold an edge of the lid 13, and is provided with a seat 23*a* for holding a flange on the edge of the lid 13. In some embodiments, the lid is bolted or adhered to the support member 14. At the top of the support member 14, the cross-section of the channel 18 is shown to be circular 25. In other embodiments, the channel has a differently shaped cross-section, such as square or ovoid. In such circumstances, the design of the retaining members is also different to allow movement between the active and stowed positions. Of course, the circular cross-section is particularly advantageous for allowing rotation of the retaining members 19 from the active to the stowed positions.

FIG. 3 shows a close-up view of a retaining member 19, including the protrusion 29, anchoring mechanism 20, and elongated portion 21. In this embodiment, the anchoring mechanism 20 is a threaded sleeve that engages threads 28 on the end of the retaining member 19 near the protrusion 29. By rotating the anchoring mechanism 20 around the threads 28, the anchoring mechanism will move along the longitudinal axis of the elongated portion 21. At the end of the retaining member 19 is a protrusion 29, in this embodiment a cylindrical bolt-like piece, which is sized to fit in the channel 18 so that it can slide along the channel freely. The arrangement of the protrusion 29 in the circular portion 25 of the channel 18 allows the retaining member to slide along the channel 18 and to be rotated into the notch 22. In the embodiment shown in the drawings, the threads 28 extend all the way to the end of the elongated portion 21, and these threads 28 correspond to threads formed in a hole on the protrusion 29. This permits the protrusion 29 to be attached to the end of the elongated portion 21. In other embodiments, the elongated portion is simply welded to the protrusion 29. In still other embodiments, the entire retaining member 19 is a cast, forged, or machined part.

In embodiments in which the channel 18 in the support member 14 is square or ovoid, such that rotation of the protrusion 29 relative to the channel is not possible, the protrusion 29 itself includes features to allow rotation of the elongated portion 21 relative to the protrusion 29. For example, in one embodiment, a ring is attached to the end of the elongated portion 21 which is permitted to rotate freely relative to a protrusion having a square cross-section.

The shape of the elongated portion 21 shown in FIG. 3 is curved so as to provide maximum contact with a cooking vessel. Other embodiments have different shapes. The material used for the retaining members is any material suitable for the high temperatures able to avoid corrosion due to exposure to moisture and other substances associated with cooking. Stainless steel is particularly advantageous, as are other metals, ceramics, and even some heat-resistant plastics. In some embodiments, a gripper sheath is disposed on the retaining member, which is made from a heat-resistant thermoplastic, to provide additional grip on a cooking vessel via increased friction therebetween.

Figure 4:
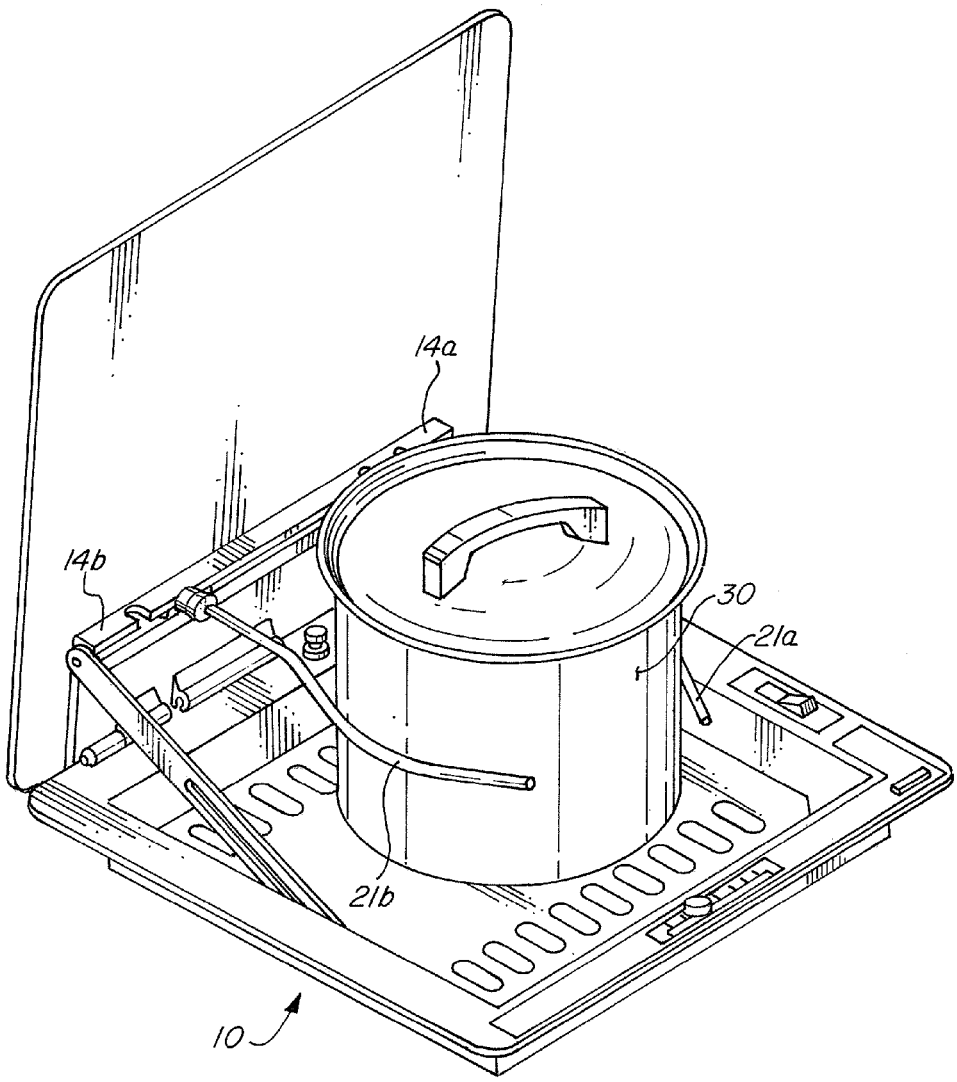
FIG. 4 is an isometric view of a stove that includes a pot retaining device according to the present invention with a cooking vessel placed thereon.

FIG. 4 shows a stove 10 with the retaining members 19 in the active position to hold a cooking vessel (pot 30). As shown, the curved portions 21*a* and 21*b* curve around the pot 30 to prevent it from sliding out from between the retaining members. When in the active position, the anchoring mechanisms 20 are tightened against the support member 14 to prevent the retaining members 19 from sliding along the support member 14 when the pot 30 is being held in place. FIG. 4 also shows an advantageous embodiment in which two support members 14*a* and 14*b* are used instead of a single, continuous member as shown in FIGS. 1 and 2. The remaining aspects of the design of the support members 14*a* and 14*b*, such as channel shape, notch design, etc., need not change.

Figure 5:
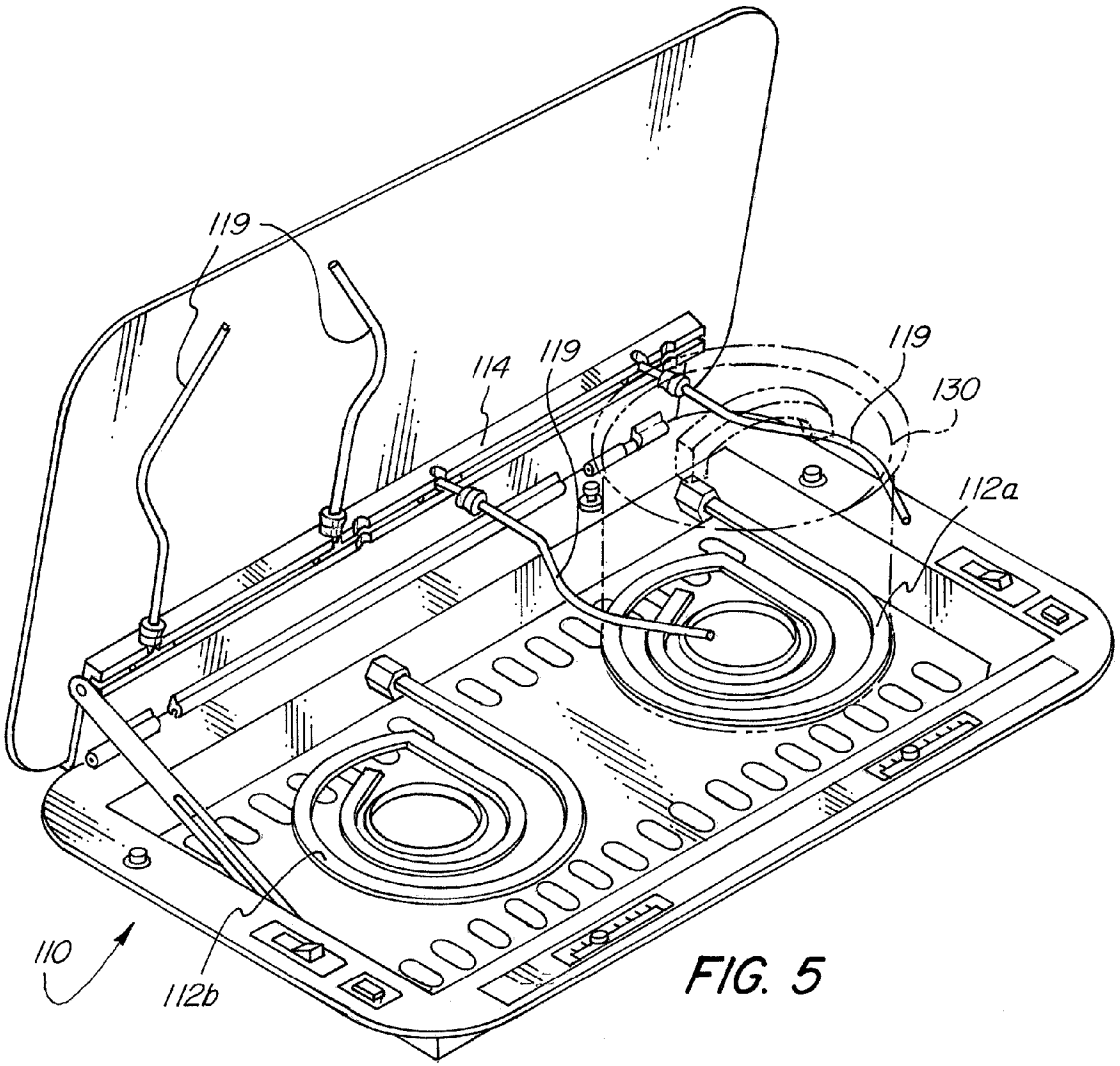
FIG. 5 is an isometric view of a stove having two cooking zones and a pot retaining device according to the present invention.

The stove 10 shown in FIG. 1 has a single heating element and a single cooking zone. In other embodiments, however, the invention is advantageously employed on stoves with multiple heating elements and cooking zones. FIG. 5 shows a stove 110 with two heating elements 112*a* and 112*b*. Stove 110 shares most of its components and design with stove 10. The most important difference is that the single support member 114, which is around twice the length of the support member 14 used with stove 10, supports four retaining members 119. The function of the components, such as the retaining members 119, is the same. Pot 130 is shown in phantom on heating element 112*a*. In some embodiments, multiple support members 114 are used in multiple-heating element stoves. For example, two, three, or even four separate support members 114 are advantageously used in, for example, a side-by-side configuration.

In some embodiments, the stove 10 is not intended to be mounted in a counter or table, but is a completely portable device which can be carried by hand. Such design variations are within the skill of one of ordinary skill in the art and need not be described in detail herein.

Although the invention has been described with reference to several embodiments with certain constructions, structures, materials and the like, these are not intended to exhaust all possible arrangements or features, and indeed many other modifications and variations will be ascertainable to those of skill in the art.

What is claimed is:

1. A device for securing at least one cooking vessel placed in at least one cooking zone of a stove, said device comprising:

at least one support member proximate to the at least one cooking zone;

at least one retaining member, for contacting the at least one cooking vessel when said at least one retaining member is in an active position, said at least one retaining member being slidably supported by said at least one support member; and at least one anchoring mechanism movably disposed on said at least one retaining member, said at least one anchoring mechanism being movable between a locked position in which it inhibits movement of the at least one retaining member relative to the at least one support member and an unlocked position in which said at least one retaining member is permitted to slide relative to said at least one support member;

wherein said at least one support member includes at least one stow port adapted to support said at least one retaining member in a stowed position.

2. The device of claim 1, wherein said at least one retaining member comprises a first retaining member and a second retaining member each slidably supported by said at least one support member; and wherein said at least one anchoring mechanism comprises a first anchoring mechanism and a second anchoring mechanism, said first anchoring mechanism being movably disposed on said first retaining member and said second anchoring mechanism being movably disposed on said second retaining member.

3. The device of claim 2, wherein said at least one support member comprises a first support member and a second support member; and wherein said first retaining member is slidably supported by said first support member and said second retaining member is slidably supported by said second support member.

4. The device of claim 1, wherein said at least one support member is proximate to a first cooking zone and a second cooking zone;

wherein said at least one retaining member comprises a first retaining member and a second retaining member for contacting a cooking vessel placed in the first cooking zone and a third retaining member and a fourth retaining member for contacting a cooking vessel placed in the second cooking zone, each retaining member being slidably supported by said at least one support member; and wherein said at least one anchoring mechanism comprises a first anchoring mechanism movably disposed on said first retaining member, a second anchoring mechanism movably disposed on said second retaining member, a third anchoring mechanism movably disposed on said third retaining member, and a fourth anchoring mechanism movably disposed on said fourth retaining member.

5. A device for securing at least one cooking vessel placed in at least one cooking zone of a stove, said device comprising:

at least one support member located proximate to the at least one cooking zone of a stove, said at least one support member having a channel formed along its length;

at least one retaining member having a protrusion on an end thereof and an elongated portion for contacting the at least one cooking vessel when said retaining member is in an active position, said protrusion being slidably disposed in the channel; and at least one anchoring mechanism movably disposed on said at least one retaining member, said at least one anchoring mechanism being movable between a locked position in which it bears against said at least one support member for anchoring said retaining member in place and an unlocked position in which said retaining member is permitted to slide relative to said at least one support member.

6. The device of claim 5, wherein said at least one support member has at least one notch formed adjacent to the channel, said notch being sized to accommodate the elongated portion of the retaining member when the retaining member is placed in a stowed position.

7. The device of claim 6, wherein said at least one notch is formed on a portion of said at least one support member such that the angle formed by the elongated portion when it is in the active position and the elongated portion when it is in the stowed position is about 90°.

8. The device of claim 5, wherein said at least one support member is secured to a lid, and said lid is attached to a stove housing by a hinge.

9. The device of claim 8, wherein a portion of said hinge is integral with said at least one support member.

10. The device of claim 9, wherein said at least one support member is adapted to engage a stove cut-off switch mounted on the stove housing.

11. The device of claim 5, wherein said at least one retaining member comprises two retaining members, and the elongated portion of each retaining member is curved for fitting around a cooking vessel.

12. The device of claim 5, wherein the elongated portion of the at least one retaining member includes an area having threads and wherein the at least one anchoring member is a sleeve disposed coaxially on the elongated portion that has threads that correspond to those on the elongated portion.

13. A stove, comprising:

a housing;

at least one heating element disposed in said housing and forming at least one cooking zone for heating a cooking vessel;

a lid, attached to said housing by a hinge;

at least one support member proximate to said at least one cooking zone; said at least one support member having a channel formed along its length;

a first retaining member having a first protrusion on an end thereof and a first elongated portion for contacting a cooking vessel when said first retaining member is in an active position, said first protrusion being slidably disposed in the channel;

a second retaining member having a second protrusion on an end thereof and a second elongated portion for contacting a cooking vessel when said second retaining member is in an active position, said second protrusion being slidably disposed in the channel;

a first anchoring mechanism movably disposed on said first retaining member, said first anchoring mechanism being movable between a locked position in which it bears against the at least one support member for anchoring said first retaining member in place and an unlocked position in which said first retaining member is permitted to slide relative to said at least one support member; and a second anchoring mechanism movably disposed on said second retaining member, said second anchoring mechanism being movable between a locked position in which it bears against the at least one support member for anchoring said second retaining member in place and an unlocked position in which said second retaining member is permitted to slide relative to said at least one support member.

14. The stove of claim 13, wherein said at least one support member is attached to said lid and a portion of said hinge is integral with said at least one support member.

15. The stove of claim 13, wherein said at least one support member further comprises:

a first notch formed adjacent to said channel, said first notch being sized to accommodate the first elongated portion when said first retaining member is in a stowed position; and a second notch formed adjacent to said channel, said second notch being sized to accommodate the second elongated portion when said second retaining member is in a stowed position.

16. The stove of claim 15, wherein said channel is accessible via an opening made on a front surface of said at least one support member and said first and second notches are formed in a top surface of said at least one support member that is adjacent to the front surface such that the angle formed by said first and second elongated portions when they are in the active position and said first and second elongated portions when they are in the stowed positions is about 90°.

17. The stove of claim 13, further comprising a stove cut-off switch mounted on the housing in a position that activation of the stove cut-off switch by the lid when said lid is placed in a closed position.

* * * * *